United States Patent [19]

Malec

[11] 4,426,305

[45] Jan. 17, 1984

[54] LUBRICATING COMPOSITIONS CONTAINING BORONATED NITROGEN-CONTAINING DISPERSANTS

[75] Inventor: Robert E. Malec, Ladue, Mo.

[73] Assignee: Edwin Cooper, Inc., St. Louis, Mo.

[21] Appl. No.: 499,917

[22] Filed: Jun. 1, 1983

Related U.S. Application Data

[63] Continuation-in-part of Ser. No. 246,280, Mar. 23, 1981, abandoned.

[51] Int. Cl.[3] ..... C10M 1/54

[52] U.S. Cl. ..... 252/49.6

[58] Field of Search ..... 252/49.6

[56] References Cited

U.S. PATENT DOCUMENTS

| | | | |
|---|---|---|---|
| 3,254,025 | 5/1966 | LeSuer | 252/49.6 X |
| 3,282,955 | 11/1966 | LeSuer | 252/49.6 X |
| 3,344,069 | 9/1967 | Steube | 252/49.6 |
| 3,368,972 | 2/1968 | Otto | 252/51.5 R X |
| 3,413,347 | 11/1968 | Worrel | 252/51.5 R X |
| 3,697,574 | 10/1972 | Piasek et al. | 252/49.6 X |
| 3,718,663 | 2/1973 | Piasek et al. | 252/49.6 X |
| 3,756,953 | 9/1973 | Piasek et al. | 252/49.6 |
| 3,798,165 | 3/1974 | Piasek et al. | 252/51.5 R |
| 3,803,039 | 4/1974 | Piasek et al. | 252/51.5 A |
| 4,159,957 | 7/1979 | de Vries | 252/49.6 |

*Primary Examiner*—Andrew Metz

*Attorney, Agent, or Firm*—Donald L. Johnson; John F. Sieberth; Joseph D. Odenweller

[57] ABSTRACT

Lubricating oil dispersancy is synergistically improved by use of a combination of (a) a boronated hydrocarbon-substituted succinic amide/imide/ester of an oxyalkylated amine and (b) a Mannich condensation product of a hydrocarbon-substituted phenol, formaldehyde, and amine, and optionally, a fatty acid and or a boronating agent.

7 Claims, No Drawings

LUBRICATING COMPOSITIONS CONTAINING BORONATED NITROGEN-CONTAINING DISPERSANTS

PRIOR APPLICATION

This application is a continuation-in-part of application Ser. No. 246,280 filed Mar. 23, 1981 and now abandoned.

BACKGROUND OF THE INVENTION

Dispersants are used in engine lubricating oil to prevent sludge formation and to inhibit varnish on hot engine surfaces such as pistons. Hydrocarbon-substituted succinimides are quite effective in such use (U.S. Pat. No. 3,172,892). Likewise, succinimides of hydroxyalkyl substituted amines have been shown to be effective (U.S. Pat. No. 3,219,666). Boronation of such succinimides has also been practiced (U.S. Pat. Nos. 3,322,670; 3,254,025).

Mannich dispersants made from hydrocarbon-substituted phenols, formaldehyde and amines are also known (U.S. Pat. Nos. 3,413,347; 3,725,277; 3,368,972; 3,798,165). Boron-modified Mannich dispersant are described in U.S. Pat. Nos. 3,697,574; 3,703,536; 3,704,308; 3,751,365; and 3,756,953. Fatty acid modified Mannich dispersants are described in U.S. Pat. Nos. 3,798,247 and 3,803,039.

SUMMARY

According to the present invention, improved lubricating oil compositions are provided which contain a synergistic combination of (a) a boronated hydrocarbon-substituted succinic amide-imide/ester of an oxyalkylated amine and (b) a Mannich condensation product of a hydrocarbon-substituted phenol, formaldehyde and an amine and optionally a boronating agent and/or fatty acid. In a standard ASTM Sequence VD engine test, the synergistic combination gives a much better piston varnish rating than either individual component used at the same or even greater total concentration.

DESCRIPTION OF PREFERRED EMBODIMENTS

A preferred embodiment of the invention is a lubricating oil composition comprising a major amount of an oil of lubricating viscosity containing a minor dispersant amount of a synergistic combination of dispersants, said combination comprising (A) a boronated succinimide dispersant having in its structure at least one aliphatic hydrocarbon-substituted succinoyl group

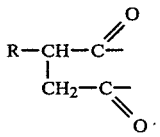

wherein R is an aliphatic hydrocarbon group having a molecular weight of about 700–50,000, said succinoyl group being bonded to a nitrogen atom of an oxyalkylated amine to form an amide or imide or to an oxygen atom of said oxyalkylated amine to form an ester or to both nitrogen and oxygen atoms of said oxyalkylated amine to form a mixture containing amide, imide and ester groups, said succinimide dispersant being further characterized by containing about 0.001–2.5 weight percent boron, and (B) a Mannich dispersant having in its structure an aliphatic hydrocarbon-substituted phenolic group

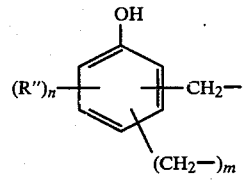

wherein R″ is an aliphatic hydrocarbon group containing 1 to about 500 carbon atoms and n is 1 or 2, m is 0 or 1, n+m is 1 or 2, at least one of said R″ groups being an aliphatic hydrocarbon group containing about 50–500 carbon atoms, said phenolic group being bonded through a methylene group to a nitrogen atom of an amine, said amine containing 1 to about 10 nitrogen atoms and 1 to about 30 carbon atoms.

Several examples of the boronated succinimide dispersant are known. They are exemplified by U.S. Pat. Nos. 3,087,936 and 3,254,025 incorporated herein by reference. The boronated succinimide dispersant can be made by reacting an aliphatic hydrocarbon-substituted succinic acid anhydride or lower alkyl ester with an oxyalkylated amine and a boronating agent in the approximate mole ratio of 1.0:0.2–2.0:001–5.0. The preferred succinic reactant is an aliphatic hydrocarbon-substituted succinic anhydride in which the aliphatic hydrocarbon group has a molecular weight of about 700–50,000. The aliphatic hydrocarbon group is preferably derived from an olefin polymer such as polypropylene, polybutene, ethylene-propylene copolymer, ethylene-propylene-1,4-hexadiene copolymer, ethylene-propylene-1,4-cyclohexadiene copolymer, ethylene-propylene-1,5-cycloctadiene copolymer, ethylene-propylene-5-methylene-2-norbornene, or ethylene-propylene-2,5-norbornadiene copolymer.

The most preferred aliphatic hydrocarbon substituent is derived from an olefin polymer having a molecular weight of about 700–5000. These include the olefin polymers mentioned above whch have the more preferred molecular weight. Of the above, polybutene is most preferred. Optionally, a high molecular weight of olefin polymer, for example, one having a molecular weight of 50,000 or more can be degraded to produce an olefin polymer having a more preferred molecular weight. Methods of reducing the carbon chain length of olefin polymers by shearing are well known. Mere heating with mechanical stirring will reduce molecular weight. Air can be injected into heated polymer to cause degradation and reduce molecular weight. Extrusion through an orifice under pressure causes chain scission. Any combination of such methods can be used.

Highly preferred olefin polymers for use in making the succinic substituent are polymers of butene. Of these, the most preferred are the polybutenes having an average molecular weight of about 700–2000.

The hydrocarbon substituent can be introduced by heating a mixture containing the olefin polymer and maleic anhydride to about 200°–250° C. The reaction can be catalyzed by injecting chlorine. Likewise, a peroxide catalyst can be used. The reaction is preferably conducted in a mineral oil diluent which can remain in the succinic product to act as a solvent in later stages of the preparation. The aliphatic hydrocarbon-substituted succinic anhydrides are well known.

The oxyalkylated amines are readily made by reacting an alkylene oxide with an amine having primary and/or secondary amine groups. The preferred alkylene oxides are ethylene oxide, propylene oxide, and butylene oxide. The more preferred are ethylene oxide, and propylene oxide or mixtures thereof. The most preferred oxyalkylating agent is ethylene oxide.

The amines which are oxyalkylated are those containing 2 to about 10 nitrogen atoms. More preferably, they also contain about 2–20 carbon atoms. Some examples of these amines are ethylenediamine, 1,2-propylenediamine, 1,3-propanediamine, N-aminoethyl piperazine, N-oleylaminopropyl1,3-propane diamine, diethylene triamine, triethylene tetramine, tetraethylene pentamine, pentaethylene hexamine, N-dodecyl ethylenediamine, N-dodecyl-1,3-propane diamine, N-octadecyl diamine, N-(decylaminoethyl)ethylenediamine and the like.

The preferred amines for use in making the succinic dispersants are the polyalkyleneamines. They are sometimes referred to as alkylene polyamines or polyalkylene polyamines. These amines consist mainly of polyamines having the structure $$H_2N\text{-}(R'''\text{—}NH)_p\text{—}H$$

wherein R'''is a divalent aliphatic hydrocarbon group containing 2 to about 4 carbon atoms and p is an integer from 1 to about 6. Representative examples are ethylenediamine, 1,2-propylenediamine, 1,2-butylenediamine, 1,3-propanediamine, diethylenetriamine, triethylene tetramine, tetraethylene pentamine (TEPA), pentaethylene hexamine, hexaethyleneheptamine and the like. Of these, the most preferred are the polyethylene amines containing 2 to about 6 ethylene amine units such as diethylene triamine, triethylene tetramine, tetraethylene pentamine, and the like, including mixtures thereof.

Reaction of the alkylene oxide with the amine forms hydroxyalkyl groups having the formula

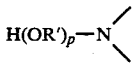

wherein R' is a divalent aliphatic hydrocarbon group containing 2 to about 4 carbon atoms and p is an integer from 1 to about 10. The value of p depends upon how many moles of alkylene oxide are reacted per mole of amine. Preferably, the amount of alkylene oxide reacted is sufficient to provide an average of about 1–4 oxyalkylene units per molecule of amine.

More preferably, the molecules of alkylene oxide reacted are at least one less than the number of equivalents of reactive amine groups in the amine. A reactive group is one that has at least one hydrogen atom bonded to it—in other words, primary or secondary amine groups. For example, one mole of ethylenediamine has two reactive amine groups and hence represents two equivalents. Likewise, one mole of tetraethylene pentamine is five equivalents. Therefore, one mole of ethylenediamine is preferably oxyalkylated with up to one mole of alkylene oxide. Likewise, one mole of tetraethylene pentamine is preferably oxyalkylated with up to 4 moles of alkylene oxide. The minimum amount of alkylene oxide is about 0.1 moles per mole of amine; more preferably, about 0.5 mole of amine. Hence, the preferred amount is 0.5–4 moles.

Oxyalkylation introduces hydroxyalkyl groups. Rather than carrying out the oxyalkylation of the amine, it is also possible to acquire hydroxyalkyl substituted amines from commercial sources, and use these in making the succinic dispersant. This is considered equivalent.

Boron is introduced into the succinimide additive by use of a boronating agent. Boronating procedures are shown in U.S. Pat. Nos. 3,089,936; 3,254,025; 3,082,955; 3,950,341; 3,322,670, all of which are incorporated herein by reference. Suitable boronating agents include any boron compound that will serve to introduce boron into the succinimide and not adversely affect the dispersant properties of the additive combination. Useful boronating agents include boron oxides such as $B_2O_3$, boron acids such as $H_3BO_3$, lower alkyl esters of boron acids such as trimethylborate or triethylborate, boron halides such as $BF_3$, or $BCl_3$, salts of boron acids, such as sodium borate, or ammonium borate and the like. The most preferred boronating agent is boric acid.

The amount of boronating agent should be an amount sufficient to introduce at least 0.001 weight percent boron into the succinimide product excluding inert diluent such as mineral oil. The preferred amount of boron in the succinimide exclusive of diluent is 0.001–2.5 weight percent, more preferably 0.005–0.5 weight percent. Excess boronating agent can be used and any remaining unreacted can be removed by filtration.

The boronated succinimide dispersant can be made by reacting the aliphatic hydrocarbon-substituted succinic acid, anhydride or ester with the oxyalkylated amine and the boronating agent. These can be reacted in any sequence or altogether. For example, the boronating agent can be reacted with the oxyalkylated amine to form an intermediate which is then reacted with the succinic compound. Alternatively, the boronating agent can first be reacted with the succinic compound to form an intermediate which is then reacted with the oxyalkylated amine.

More preferably, the boronated succinimide dispersant is made by one of the following two procedures. In the first procedure, the hydrocarbon-substituted succinic compound (preferably polybutenyl substituted succinic anhydride) is reacted with the oxyalkylated amine (preferably oxyethylated polethyleneamine) to form an intermediate which is then reacted with the boronating agent (preferably boric acid).

In a second more preferable procedure, a mixture of all three reactants (i.e. hydrocarbyl succinic compound, oxyalkylated amine and boronating agent) is formed and heated to react all at once.

The reaction temperature is not critical. Any temperature high enough to cause the reaction to proceed but no so high as to cause degradation of the reactants or products can be used. A preferred temperature range for use in any of the different methods of making the boronated succinimide is about 100°–300° C., more preferably 150°–250° C.

The aliphatic hydrocarbon-substituted succinic compound reacts with the oxyalkylated amine to form amides, imides, esters and mixtures thereof. These are referred to collectively herein as succinimides. Imide formation can be shown by the following structure

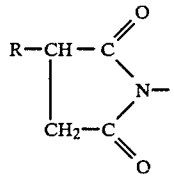

in which the remaining bond on nitrogen is bonded to the remaining part of the oxyalkylated amine. Amide formation can be illustrated by the structure

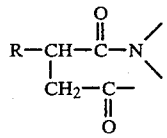

Likewise, ester formation involving the hydroxyalkyl group formed in the oxyalkylation can be shown as follows:

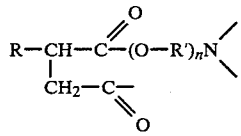

In practice, the product is a mixture of imides, amides and esters with the majority of the product having succinimide units.

The second required component of the synergistic combination is the Mannich dispersant made from an aliphatic hydrocarbon-substituted phenol, an aldehyde, or aldehyde precursor and an amine having at least one primary or secondary amine group. This leads to a Mannich condensate which can be defined by the presence within its structure of an aliphatic hydrocarbon-substituted phenolic group having the formula

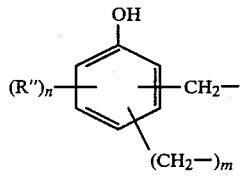

wherein R″ is an aliphatic hydrocarbon group containing one to about 500 carbon atoms, and n is one or two, m is 0 or 1 and n+m is 1 to 2. At least one R″ group contains about 50–500 carbon atoms. The methylene bridge(s) is (are) bonded to a nitrogen atom of the amine. Such dispersants are well known and can be represented by the following U.S. Pat. Nos. 3,368,972; 3,413,347; 3,442,808; 3,448,047; 3,725,277; 3,539,633; 3,634,515; 3,697,574; 3,703,536; 3,704,308; 3,736,357; 3,751,365; 3,756,953; 3,793,202; 3,798,165; 3,798,247; 3,803,039; 4,142,980; 4,006,089; 3,980,569; 4,071,327; 4,070,402; 3,985,802; 4,161,475; 4,170,562; 4,016,092 (all U.S. patents) and British Pat. No. 1,362,013, incorporated herein by reference.

The Mannich dispersants are readily made starting with an aliphatic hydrocarbon-substituted phenol having the formula

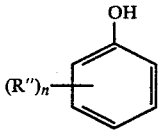

wherein R″ and n are as previously defined. These compounds can be made by reacting an olefin having the proper molecular weight with phenol or a monoalkyl substituted phenol. The olefin should contain about 50–500 carbon atoms which give a molecular weight of about 700–7000. The olefin reactant is preferably made by polymerizing a lower olefin such as ethylene, propylene, isobutylene, α-hexene, α-octene and mixtures thereof. Thus, useful olefin polymer reactants are polybutene, polypropylene, ethylene-propylene copolymer, and the like. Terpolymers can also be used to introduce the aliphatic hydrocarbon group. These include ethylene-propylene copolymers with dienes such as a 1,4-hexadiene, 1,5-hexadiene, 1,4-cycloctadiene, dicyclopentadiene, and the like.

The more preferred aliphatic hydrocarbon-substituted phenol reactant is polybutenyl phenol made by reacting a polybutene of 700–7000 molecular weight with phenol using a $BF_3$ catalyst such as $BF_3$ phenate or the rae at 0°–60° C. Some more preferred reactants are those in which the polybutenyl group has a molecular weight of about 1000–3000.

The methylene bridge attached at one end of the phenol is introduced by reaction with an aldehyde such as formaldehyde or a formaldehyde precursor such as paraformaldehyde. One or two such bridges may form.

The other end of the methylene bridge is bonded to a nitrogen atom of an amine. Preferred amines contain 1 to about 10 nitrogen atoms and 1 to about 30 carbon atoms. More preferred amines are aliphatic amines. Examples of such amines are methyl amine, ethyl amine, isobutyl amine, lauryl amine, oleyl amine, stearyl amine, eicosamine, tricontamine, N-propylethylene diamine, N-dodecyl-1,3-propanediamine, N-(dodecyl aminoethyl) ethylene diamine, N-(eicosylaminoethyl) ethylenediamine, N-aminoethylpiperazine, 1,3-propane diamine, N,N-dimethyl-1,3-propanediamine, 1,6-hexane diamine and the like.

A preferred class of amines for use in making the Mannich dispersants is the polyalkyleneamines which were also a preferred class of amines for use in making the succinimide dispersants. They were previously described and exemplified.

Fatty acids useful in modifying the Mannich dispersants include the aliphatic carboxylic acids containing 4 to about 30 carbon atoms. The more preferred fatty acids are those containing about 10–30 carbon atoms such as capric acid, undecylic acid, lauric acid, tridecoic acid, myristic acid, palmitic acid, linoleic acid, stearic acid, arachidic acid and the like. The preferred fatty acid is oleic acid. The use of such fatty acidsin modifying Mannich dispersants is described in more detail in U.S. Pat. Nos. 3,798,247 and 3,803,039.

Boron compounds useful in modifying the Mannich dispersant are the same boron compounds used to boronate the succinimide dispersants. These are boron oxides, boron acids, esters of boron acids, salts of boron acids, boron halides, and mixtures thereof. The preferred boronating agent is boric acid. Use of such boronating agents in modifying Mannich dispersants is described in more detail in U.S. Pat. No. 3,751,365 and 3,756,953.

The Mannich dispersants are made by reacting about one mole of aliphatic hydrocarbon-substituted phenol, about 0.9–2.5 moles of formaldehyde or formaldehyde precursors, about 0.1–2.0 moles of amine, 0 to about 3 moles of fatty acid and 0 to about 2.0 moles of boronating agent. These can be reacted in any order or altogether. In a preferred method, the Mannich dispersant is made by heating a mixture of aliphatic hydrocarbon substituted phenol and amine at about 60°–200° C. and adding a formaldehyde to the heated mixture to form a Mannich condensate. If boronated Mannich is used the boronating agent (e.g. boric acid) can be added subsequently to the mixtureand heating to about 100°–250° C. as the desired amount of boron is introduced. Alternatively, part of the Mannich condensate can be segregated and heated with a boronating agent (e.g. boric acid) to introduce a higher level of boron than is desired in the final Mannich. This overboronated product can then be blended back into the unboronated Mannich to achieve the desired boron level. The final Mannich can be clarified by filtration.

Fatty acid modified Mannich dispersants can be made by heating a mixture of aliphatic hydrocarbon-substituted phenol, formaldehyde, amine and fatty acid to about 50° to 150° C. More preferably, the formaldehyde is withheld and added slowly to a mixture of the other reactants while stirring at 50°–150° C.

The Mannich dispersant can be modified with both boron and fatty acid. This can readily be accomplished by combining the foregoing procedures. For example, one can heat a mixture of hydrocarbon-substituted phenol (e.g., polybutenyl phenol), amine (e.g. tetraethylene pentamine) and fatty acid (e.g. oleic acid) to reaction temperature and then add formaldehyde and subsequently a boronating agent (e.g. boric acid). Alternatively, one can form a mixture of hydrocarbon-substituted phenol, amine, boronating agent and fatty acid and add formaldehyde to the heated mixture. In another procedure, the Mannich condensate of hydrocarbon-substituted phenol formaldehyde and amine is split into separate portions. One portion is heated with a boronating agent such as boric acid and the second portion is heated with a fatty acid such as oleic acid to obtain two separate modified intermediate products. These products can then be blended back together to obtain a Mannich condensate which is both boron and fatty acid modified. Other reaction sequences involving the condensation of hydrocarbon-substituted phenol, amine, formaldehyde, boronating agent, and fatty acid will be apparent to the average chemist.

The following examples illustrate the preparation of the succinimide type dispersants.

EXAMPLE 1

In a reaction vessel was placed 1080 grams (6.0 moles) of a mixture of polyethyleneamine having an average composition corresponding to tetraethylene pentamine. This was stirred under nitrogen and heated to about 120° C. Then 441 grams (10.0 moles) of ethylene oxide was injected over a 3.5 hour period to form an oxyethlated polyethyleneamine.

In a second reaction vessel was placed 101.6 grams (about 0.4 moles) of the above oxyethylated polyethyleneamine, 28.8 grams (0.47 moles of boric acid 9.6 grams of water and 727 grams (about 0.6 moles) of a polybutenyl succinic anhydride. This mixture was stirred under nitrogen and heated to 175° C. over a three hour period. It was then stirred for an additional hour at 175° C. while vacuum was applied to remove a residual water. percent active dispersant. It was clarified by filtration. Analysis gave amine number 0.85, acid number 0.09, nitrogen 1.84 weight percent, boron 0.3 weight percent.

EXAMPLE 2

In a reaction vessel was placed 1124 grams (1.3 moles) of polyisobutenyl succinic anhydride and 254 grams (1.0 mole) of oxyethylated polyethyleneamine made by reacting about 1.67 moles of ethylene oxide with one mole of polyethyleneamine having an average molecular weight of 180. This mixture was heated under nitrogen to 175° C. while bubbling nitrogen through the liquid and maintaining a vacuum of about 26.5 inches (Hg) for 4.5 hours. The resultant product was diluted with mineral oil to give a 67 percent active material. Then 75 grams (1.2 moles) of boric acid and 25 grams of water were added. The mixture was heated to 100° C. and nitrogen was bubbled through it for three hours. It was then heated to 150° C. and nitrogen sparge continued for two hours. The product was filtered to obtain a clear boronated succinimide dispersant for use in the synergistic combination. It analyzed 2.42 weight percent nitrogen, 0.49 weight percent boron, amine number 1.16 total base number 34.4 and acid number 0.03.

EXAMPLE 3

In a reaction vessel was placed 396 grams (2.2 moles) of polyethyleneamine having an average composition corresonding to tetraethylene pentamine. This was heated to 120° C. and 162 grams (3.7 moles) of ethylene oxide was injected into the amine at 120–140 over a 2.5 hour period.

In a second reaction vessel was placed 254 grams (about 1 mole) of an oxyethylated polyethyleneamine, 93 grams (1.5 moles) boric acid and 47 grams of water. This was stirred at 100° C. with nitroge sparge for three hours. It was then heated to 150° C. and nitrogen sparge continued for two hours to obtain a boronated-oxyethylated polyethyleneamine.

In another reaction vessel was placed 1798 grams (1.6 moles) of polybutenyl succinic anhydride and 222 (0.75 moles) of the above boronated-oxyethylated polyethyleneamine. This mixture was placed under vacuum with nitrogen sparge and heated to 175° C. for 4.5 hours. The product was diluted with mineral oil to be 67 percent active. It analyzed 0.2 weight percent boron.

EXAMPLE 4

In a reaction vessel was placed 1487 grams (1.6 moles) of polybutenyl succinic anhydride, 74 grams (1.5 moles) boric acid and 24 grams of water. This mixture was stirred and heated under nitrogen at 100° C. for three hours, and then at 150° C. under vacuum for two hours. To this was then added 203 grams (0.8 mole) of an oxyethylated polyethyleneamine made by reacting 1.67 moles of ethylene oxide with 1 mole of polyethyleneamine having the average composition of a tetraethylene pentamine. This mixture was heated at 175° C. with nitrogen sparge under vacuum for 4.5 hours. The final product was diluted with one-half its weight in process oil to give a 67 percent active product and analyzed 0.13 weight percent boron.

The following example illustrates a method for making the Mannich dispersants.

EXAMPLE 5

In a reaction vessel was placed 2019 grams of heptane, 529.7 grams of polybutene (mole weight 1000) and 79.5 grams of phenol. To this was added 23.9 grams of $BF_3$ phenate over a 20-minute period at 40° C. The mixture was then stirred for 90 minutes at 40° C. It was then washed at 60°–70° C. with aqueous ammonia and then with water and finally with methanol, leaving behind the polybutenyl phenol. This was cooled to about 40° C. and 59 grams o N,N-dimethyl-1,3-propanediamine was added and stirred. Then 27.2 grams of formaldehyde was added incrementally over a 30-minute period at 40°–50° C. Stirring was continued for 30 minutes and then the mixture was heated to about 130° C. while distilling out volatiles. It was stirred three hours at 130° C. under slight nitrogen pressure and then heated to 170° C. and vacuum applied to 50 mm. Hg.abs to complete removal of volatiles. It was then diluted with about 380 grams of hydrocarbon solvent and cooled giving a Mannich dispersant useful in the present combination.

Other Mannich dispersants can be made following the above general procedure by substituting any of the previously disclosed primary and secondary amines in place of N,N-dimethyl-1,3-propanediamine. For example, tetraethylene pentamine on an equal mole basis yields an effective dispersant which may be readily modified by heating with boric acid and/or oleic acid to improve its properties, especially with regard to corrosiveness.

Each of the two types of synergistic additives is used in lubricating oil at a concentration which maximizes their total effectiveness at an acceptable cost. A useful concentration range for each is about 0.05–10 weight percent. A more preferred range is 0.5–5 weight percent and a highly preferred range is about 1–3 weight percent. These concentrations do not include any mineral oil diluent incorporated into the additive during manufacture.

The additives can be used in mineral oil or in synthetic oils of viscosity suitable for use in the crankcase of an internal combustion engine. Crankcase lubricating oils have a viscosity up to about 80 SUS at 210° F.

Crankcase lubricating oils of the present invention have a viscosity up to about SAE 50. Sometimes such motor oils are given a classification at both 0° and 210° F., such as SAE 10W 40 or SAE 5W 30.

Mineral oils include those of suitable viscosity refined from crude oil from sources including Gulfcoast, mid-continent, Pennsylvania, mideast, California, Alaska, North Sea, and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 weight percent hydrogenated α-decene trimer with 75–90 weight percent 150 SUS (100° F.) mineral oil results in an excellent lubricant. Likewise, blends of about 10–25 weight percent di(2-ethylhexyl)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g., SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkylaryldithiophosphates as well as mixed alkyl-aryl ZDDP are useful. A typical alkyl-type ZDDP contains a mixture of isobutyl and isoamyl groups. Zinc di-(nonylphenyl)dithiophosphate is a typical aryl-type ZDDP. Good results are achieved using sufficient ZDDP to provide about 0.01–0.5 weight percent zinc. A preferred concentration supplies about 0.025–0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium and/or magnesium petroleum sulfonate or alkaryl (e.g. alkylbenzene) sulfonate.

Other viscosity index improvers can be included such as the polyalkylmethylacrylate type or the ethylene-propylene or ethylene-propylenedienecopolymer type. Likewise, styrene-diene VI improvers or styrene-acrylate copolymers can be used. Alkaline earth metal salts of phosphosulfurized polyisobutylene are useful.

Tests were conducted which demonstrated the substantial synergistic effect of the present invention. The test used was industry-recognized ASTM Sequence VD engine test. In this test, a Ford Pinto engine is operated on a fixed schedule with the test oil inthe engine crankcase. After the operating schedule is complete, the engine is disassembled and various parts rated for cleanliness using a standard rating scale of 1–10 in which 10 is clean.

The base test oil was a fully formulated mineral oil. The only difference between the test oils was the dispersant. The dispersant varied as follows:

| Test Oil | Dispersant | Percent Concentration |
|---|---|---|
| A | Oxyethylated-boronated Polybutenylsuccinimide of polyethyleneamine (TEPA) | 7.0 |
| B | Boronated polybutenylphenol-formaldehyde-polyethylene-amine Mannich condensate[1] | 7.0 |
| C | Dispersant from A | 3.0 |
| | Dispersant from B | 2.0 |

-continued

| Test Oil | Dispersant | Percent Concentration |
|---|---|---|
| D | Dispersant from A | 5.6 wt. % |

[1]Commercial dispersant "Amoco 9250" from Amoco Chemical Corporation.

The test results are shown in the following table:

| | Test Oil | | | |
|---|---|---|---|---|
| | A | B | C | D |
| Average sludge | 9.46, 9.43 | 9.63 | 9.55 | 9.12 |
| Average varnish | 6.94, 7.11 | 8.00 | 8.55 | 4.73 |
| Piston varnish | 7.34, 7.68 | 7.30 | 8.26 | 7.16 |

Note that Oil C containing the synergistic combination gave a much better average varnish and piston varnish rating at 5 percent total dispersant than either Oil A or Oil B using the same individual components separately and at a much higher concentration. The results with Oil D show that the ratings drop with concentration and that Oil D containing 5.6 weight percent of dispersant A is inferior to Oil C which contains only 5.0 weight percent of present combination. Hence, the combination gives results superior to the sume of the expected contributions of the components.

I claim:

1. A lubricating oil composition comprising a major amount of an oil of lubricating viscosity containing a minor dispersant amount of a synergistic combination of dispersants, said combination comprising (A) a boronated succinimide dispersant having in its structure at least one polybutene-substituted succinoyl group

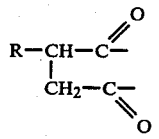

wherein R is a polybutene group having a molecular weight of about 700–2000, said succinoyl group being bonded to a nitrogen atom of an oxyethylated polyethyleneamine containing 2 to about 6 ethylene amine units to form an amide or imide or to an oxygen atom of said oxyethylated polyethyleneamine to form an ester or to both nitrogen and oxygen atoms of said oxyethylated polyethyleneamine to form a mixture containing amide, imide and ester groups, said oxyethylated polyethyleneamine being made by reacting 1 mole of polyethyleneamine with about 0.5–5 moles of ethylene oxide, said succinimide dispersant being further characterized by containing about 0.001–2.5 weight percent boron and (B) a Mannich dispersant having in its structure a polybutene-substituted phenolic group

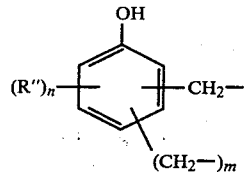

wherein R" is a polybutene group and n is 1 or 2 m is 0 or 1, n+m is 1 or 2, said R" groups containing about 50–500 carbon atoms, said phenolic group being bonded through a methylene group to a nitrogen atom of a polyethylene amine containing 2 to about 6 ethyleneamine units, at least part of said Mannich dispersant having been reacted with a fatty acid and at least part of said Mannich having been reacted with a boronating agent.

2. A lubricating oil composition of claim 1 wherein aid boronated succinimide dispersant is made by a process comprising reacting in any sequence or all together (a) about 1 mole of a polybutenyl succinic anhydride wherein said polybutenyl group has a molecular weight of about 700–2000, (b) about 0.2–2.0 moles of an oxyethylated polyethyleneamine containing 2 to about 6 ethyleneamino units and an average of about ;b 0.5–4 oxyethylene units, and (c) about 0.001 to about 5.0 moles of a boron compound selected from the group consisting of boron oxides, boron acids, esters of boron acids, salts of boron acids, boron halides, and mixtures thereof.

3. A lubricating oil composition of claim 2 wherein said boron compound is a boric acid.

4. A lubricating oil composition of claim 3 wherein said Mannich dispersant is made by a process comprising reacting in any sequence or all together (a) about one mole of a polybutenyl phenol wherein said polybutenyl group has a molecular weight of 1000–3000, (b) about 0.1–2.0 moles of formaldehyde or a formaldehyde precursor, (c) 0.1–2.0 moles of a polyethyleneamine containing 2 to about 6 ethyleneamine units, (d) 0.1 to about 2 moles of a fatty acid, and (e) 0.01 to about 1.0 moles of a boron compound selected from the group consisting of boron oxides, boron acids, esters of boron acids, salts of boron acids, boron halides, and mixtures thereof.

5. A lubricating oil composition of claim 4 wherein said fatty acid in (d) oleic acid in an amount of about 0.1–2.0 moles per mole of said polybutenyl phenol and said boron compound in (e) is boric acid in an amount of about 0.01–1.0 moles per mole of said polybutenyl phenol.

6. A lubricating oil composition of claim 5 wherein said boron compoun used to boronate said succinimide dispersant is a boric acid.

7. An additive package formulated for addition to lubricating oil to obtain a formulated motor oil suitable for use in an internal combustion engine, said package containing a synergistic combination of dispersants comprising (a) a boronated succinimide dispersant having in its structure at least one polybutene-substituted succinoyl group

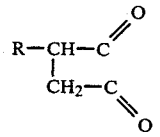

wherein R is a polybutene group having a molecular weight of about 700–2000, said succinoyl group being bonded to a nitrogen atom of an oxyethylated polyethyleneamine containing 2 to about 6 ethylenamine units to form an amide or imide or to an oxygen atom of said oxyethylated polyethyleneamine to form an ester or to both nitrogen and oxygen atoms of said oxyethylated polyethyleneamine to form a mixture containing amide, imide and ester groups, said oxyethylated polyethyleneamine being made by reacting 1 mole of polyethyleneamine with about 0.5–4 moles of ethylene oxide, said succinimide dispersant being further characterized by containing about 0.001–2.5 weight percent boron and (b) a Mannich dispersant having in its structure a polybutene-substituted phenolic group

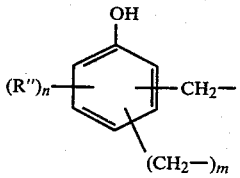

wherein R″ is a polybutene group and n is 1 or 2, m is 0 or 1, n+m is 1 or 2, said R″ groups containing about 50–500 carbon atoms, said phenolic group being bonded through a methylene group to a nitrogen atom of a polyethyleneamine containing 2 to about 6 ethyleneamine units, at least part of said Mannich dispersant having been reacted with oleic acid and at least part of said Mannich having been reacted with a boronating agent.

* * * * *